US008704617B2

(12) United States Patent
Chun et al.

(10) Patent No.: US 8,704,617 B2
(45) Date of Patent: Apr. 22, 2014

(54) TUNABLE FILTER FOR EXPANDING THE TUNING RANGE

(75) Inventors: Dong-Wan Chun, Incheon-si (KR); Jae-Ok Seo, Bucheon-si (KR); Kwang-Sun Park, Suwon-si (KR)

(73) Assignee: Ace Technologies Corp., Incheon-Si (KR)

( * ) Notice: Subject to any disclaimer, the term of this patent is extended or adjusted under 35 U.S.C. 154(b) by 439 days.

(21) Appl. No.: 13/056,772

(22) PCT Filed: Aug. 7, 2009

(86) PCT No.: PCT/KR2009/004419

§ 371 (c)(1), (2), (4) Date: Jan. 31, 2011

(87) PCT Pub. No.: WO2010/016745

PCT Pub. Date: Feb. 11, 2010

(65) Prior Publication Data

US 2011/0133861 A1 Jun. 9, 2011

(30) Foreign Application Priority Data

Aug. 7, 2008 (KR) ..... 10-2008-0077659
Aug. 7, 2008 (KR) ..... 10-2008-0077660

(51) Int. Cl.
*H01P 1/205* (2006.01)
*H01P 7/04* (2006.01)

(52) U.S. Cl.
USPC ..... 333/203; 333/224; 333/235

(58) Field of Classification Search
USPC ..... 333/202–203, 208–209, 212, 219, 227, 333/231–233, 224, 235
See application file for complete search history.

(56) References Cited

U.S. PATENT DOCUMENTS

| | | | | |
|---|---|---|---|---|
| 5,070,313 | A | 12/1991 | Gladh et al. | |
| 6,778,034 | B2 * | 8/2004 | Nir et al. | 333/202 |
| 7,180,391 | B2 | 2/2007 | Ala-Kojola | |
| 7,310,031 | B2 * | 12/2007 | Pance et al. | 333/219 |
| 7,825,753 | B2 * | 11/2010 | Park et al. | 333/203 |
| 7,834,721 | B2 * | 11/2010 | Juri | 333/202 |
| 2005/0040916 | A1 | 2/2005 | Park et al. | |
| 2006/0103493 | A1 | 5/2006 | Kley et al. | |

FOREIGN PATENT DOCUMENTS

| | | |
|---|---|---|
| EP | 1885018 | 2/2008 |
| JP | 1993095214 | 4/1993 |

* cited by examiner

*Primary Examiner* — Benny Lee
*Assistant Examiner* — Rakesh Patel
(74) *Attorney, Agent, or Firm* — Duane Morris LLP

(57) ABSTRACT

A tunable filter for expanding tuning range includes: a housing, which has multiple cavities defined by partitions; a resonator contained in the cavity; at least one sliding member installed over the resonator; a main cover coupled to an upper portion of the housing; and at least one tuning element coupled to a lower portion of the sliding member and made of a metallic material. Tuning is accomplished by a sliding motion of the sliding member, and the resonator includes a cylindrical first conductor and a second conductor coupled to an upper portion of the cylindrical conductor, where a cross section of the second conductor is shaped as a circle with a portion removed such that an area of overlap between the tuning element and the second conductor is varied according to a sliding of the tuning element.

6 Claims, 14 Drawing Sheets

(Prior Art)

(Prior Art)

(Prior Art)

TUNABLE FILTER FOR EXPANDING THE TUNING RANGE

TECHNICAL FIELD

The present invention relates to a filter, more particularly to a tunable filter which can vary its filter characteristics such as center frequency and band width.

BACKGROUND ART

A filter is a device for passing signals of only a certain frequency band from among the inputted frequency signals, and is implemented in various ways. The band-pass frequency of an RF filter may be determined by the inductance and capacitance components of the filter, and the operation of adjusting the band-pass frequency of a filter is referred to as tuning.

In a communication system, such as a mobile communication system, certain frequency bands may be allotted to certain businesses, which may divide the allotted frequency bands into several channels for use. In the related art, communication businesses generally manufacture and use a separate filter that is for suitable for each frequency band.

In recent times, however, rapid changes in the communication environment have created a need for a filter to have variable properties, such as for the center frequency and bandwidth, for example, unlike the earlier environment for mounting filters. For varying the properties in this manner, a tunable filter may be used.

FIG. 1 illustrates the structure of a tunable filter according to the related art.

Referring to FIG. 1, a filter according to the related art may include a housing 100, an input connector 102, an output connector 104, a cover 106, and multiple numbers of cavities 108 and resonators 110.

An RF filter is a device for passing signals of only a certain frequency band from among the inputted frequency signals, and is implemented in various ways.

A number of walls may be formed within the filter, with the walls defining cavities 108 in which to hold the resonators, respectively. The cover 106 may include tuning bolts 112, as well as coupling holes for coupling the housing 100 with the cover 106.

The tuning bolts 112 may be coupled to the cover 106 and may penetrate inside the housing. The tuning bolts 112 may be arranged on the cover 106 in corresponding positions in relation to the resonators or in relation to particular positions inside the cavities.

RF signals may be inputted by way of the input connector 102 and outputted by way of the output connector 104, where the RF signals may progress through the coupling windows formed in the cavities, respectively. Each of the cavities 108 and resonators 110 may generate a resonance effect of the RF signals, and this resonance effect may filter the RF signals.

In a filter according to the related art, such as that shown in FIG. 1, the tuning of frequency and bandwidth may be achieved using the tuning bolts.

FIG. 2 is a cross-sectional view of a cavity in a filter according to the related art.

Referring to FIG. 2, a tuning bolt 112 may penetrate through the cover 106 to be located above a resonator. The tuning bolt 112 may be made of a metallic material and may be secured to the cover by way of screw-coupling.

Hence, the tuning bolt 112 can be rotated to adjust its distance to the resonator, and by thus varying the distance between the resonator 110 and the tuning bolt 112, tuning may be achieved. The tuning bolt 112 can be rotated manually, or a separate machine for rotating the tuning bolt 112 can be employed. If the tuning achieved at an appropriate position, the tuning bolt may be secured using a nut.

In a filter according to the related art, as the distance between the tuning bolt and the resonator is changed due to the rotation of the tuning bolt, the capacitance can also be changed. Capacitance is one of the parameters that determines the frequency of a filter, and therefore the center frequency of a filter can be changed by altering the capacitance.

With such a filter according to the related art, tuning is only possible during the initial production, and its structure makes it difficult to accomplish tuning during use. In order to solve such difficulties, a tunable filter was proposed which employs a sliding system, with which tuning can be performed comparatively easily.

For a tunable filter using a sliding system, a sliding member is installed which can slide between resonators; tuning elements made of metallic or dielectric material are attached to a lower portion of the sliding member; and such characteristics of the filter as resonance frequency and bandwidth are tuned by the sliding motion of the sliding member.

Such a tunable filter using a sliding system has the advantage of making tuning possible just by moving the sliding member side to side, without having to turn the bolts; however, it has the problem of the tuning range not being wide. Consequently, it may be difficult to employ a tunable filter using a sliding system for tuning resonance frequency and bandwidth within a comparatively large range.

DISCLOSURE

Technical Problem

In order to resolve the aforementioned problems, the present invention proposes a tunable filter using a sliding system for obtaining a wide tuning range.

Another purpose of the present invention is to propose a tunable filter using a sliding system which, by changing the shape of resonators, can obtain a wider tuning range than general disc-shape resonators.

Yet another purpose of the present invention is to propose a tunable filter using a sliding system for obtaining a wider tuning range.

Technical Solution

In order to fulfill the aforementioned purposes, an aspect of the present invention provides a tunable filter for expanding tuning range that includes: a housing, which has multiple cavities defined by partitions; a resonator contained in the cavity; at least one sliding member installed over the resonator; a main cover coupled to an upper portion of the housing; and at least one tuning element coupled to a lower portion of the sliding member and made of a metallic material. Tuning is accomplished by a sliding motion of the sliding member, and the resonator includes a cylindrical first conductor and a second conductor coupled to an upper portion of the cylindrical conductor, where a cross section of the second conductor is shaped as a circle with a portion removed such that an area of overlap between the tuning element and the second conductor is varied according to a sliding of the tuning element.

The cross section of the second conductor may be shaped as a fan.

A sub-cover can be included between the main cover and the resonators, and the sub-cover can have a guide groove for installing the sliding member.

At least one first guide member may be coupled to at least one side surface of the sliding member, where the first guide member may guide a sliding movement by way of contact with a side surface of the guide groove.

At least one second guide member may be coupled to an upper portion of the sliding member, where the second guide member may guide a sliding movement by way of contact with a lower portion of the main cover.

An elongated hole may be formed in the guide groove of the sub-cover, so as to allow the tuning element to be inserted in the housing and enable the tuning element to freely undergo a sliding movement.

Another aspect of the present invention provides a resonator for a tunable filter that performs tuning by way of a sliding system. The resonator includes: a cylindrical first conductor and a second conductor coupled to an upper portion of the first conductor, where a cross section of the second conductor is shaped as a circle with a portion removed.

Yet another embodiment of the present invention provides a tunable filter for expanding tuning range which includes: a housing that has multiple cavities defined by partitions; a resonator contained in the cavity; at least one sliding member installed over the resonator; a main cover coupled to an upper portion of the housing; and at least one tuning element coupled to a lower portion of the sliding member and made of a metallic material, where tuning is accomplished by a sliding motion of the sliding member, and an upper portion of the resonator has a step.

Advantageous Effects

An embodiment of the present invention, by changing the shape of the resonators, has the advantage of obtaining a wider tuning range than when general disc-shaped resonators are used.

MODE FOR INVENTION

Below, certain embodiments of a tunable filter for expanding tuning range according to the present invention will be described in more detail with reference to the accompanying drawings.

Figure 1:
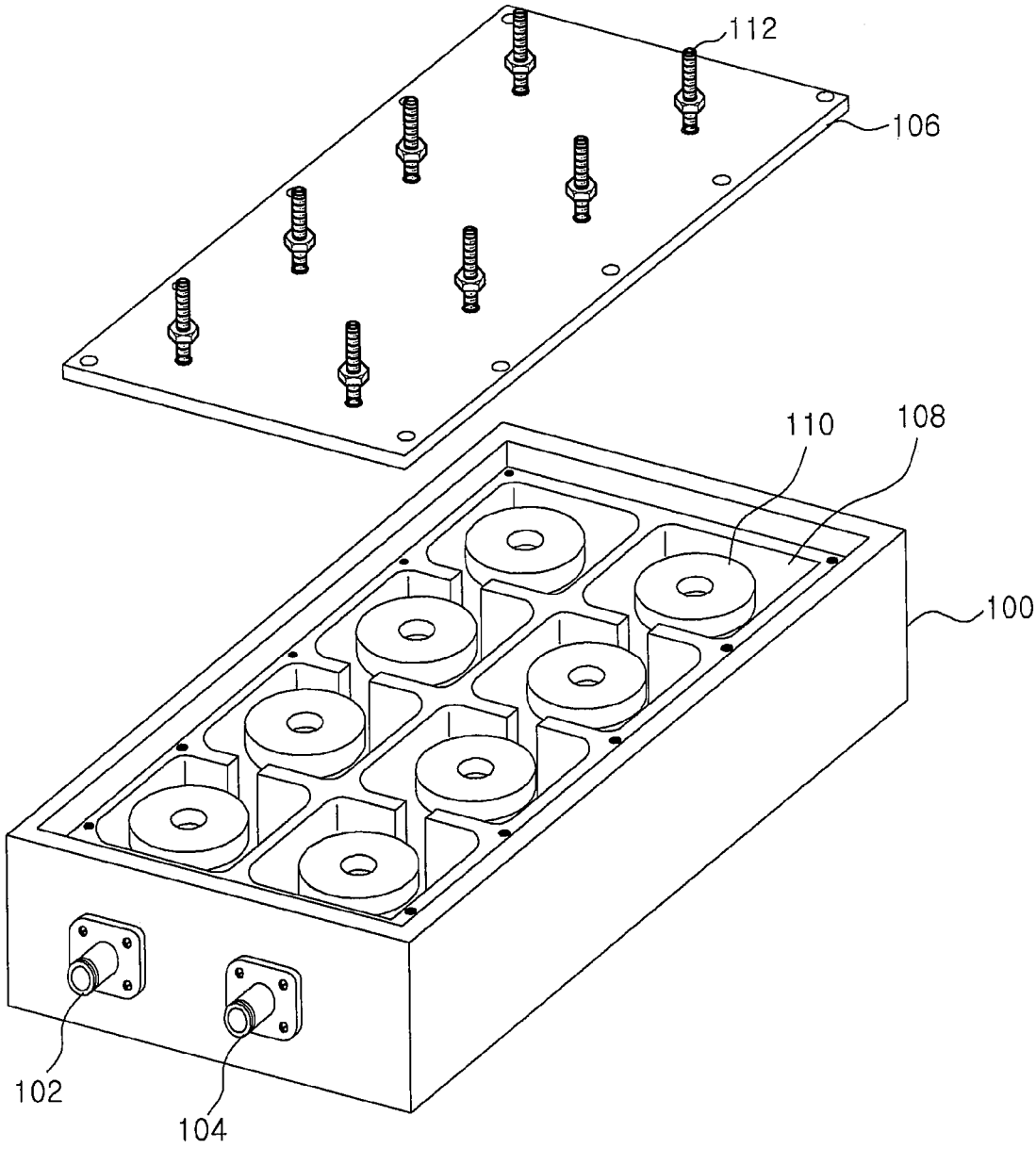
FIG. 1 is a drawing illustrating the structure of a filter according to the related art.
Figure 2:
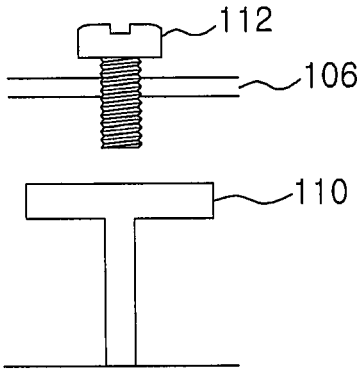
FIG. 2 is a cross-sectional view of a cavity in a filter according to the related art.
Figure 3:
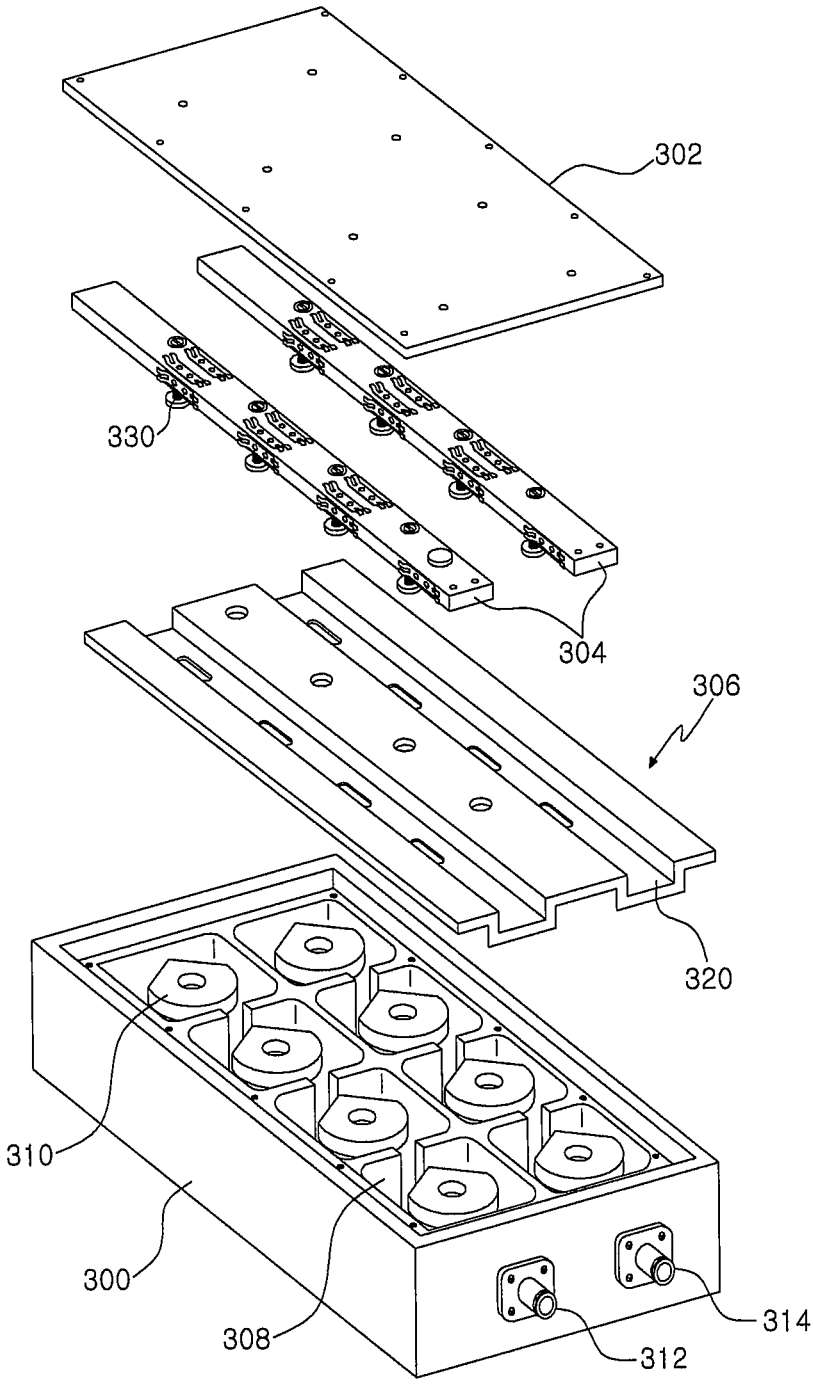
FIG. 3 is an exploded perspective view of a tunable filter using a sliding system to which an embodiment of the present invention is applied.

FIG. 3 is an exploded perspective view of a tunable filter using a sliding system to which an embodiment of the present invention is applied.

With reference to FIG. 3, a tunable filter using a sliding system, to which the present invention is applied, may comprise: a housing 300; a main cover 302; a sliding member 304; a sub-cover 306; multiple cavities 308; multiple resonators 310; an input connector 312; and an output connector 314.

The housing 300 performs the role of protecting the structural components such as resonators inside the filter and shielding electromagnetic waves. The housing 300 can be made by forming a base from an aluminum material and applying plating over the base. For RF equipment such as filters and waveguides, silver plating is generally used to minimize loss, due to its high electrical conductivity. In recent times, plating methods other than silver plating are also used, to improve properties such as corrosion resistance, for example, and a housing made using such plating methods can also be used.

The sub-cover 306 can be coupled to the housing at an upper portion of the housing, and can be coupled with the housing by bolts and fastening holes. Guide grooves 320 may be formed in the sub-cover 306, so that the sliding members 304 may undergo a sliding movement in a stable manner.

Inside the filter there are multiple partitions, and these partitions together with the filter's housing define the cavities 308, within which the resonators 310 are contained. The number of cavities and resonators is related to the order of the filter, with FIG. 3 illustrating an example having an order of eight, in other words, having eight resonators. The order of a filter is related to insertion loss and skirt characteristics. One faces a tradeoff, as a higher order of a filter results in improved skirt characteristics but poorer insertion loss, and the order of a filter may thus be set according to the insertion loss and skirt characteristics required.

In portions of the partitions, coupling windows may be formed in correspondence with the direction of progression of the RF signals. An RF signal that is resonated by a cavity and a resonator may progress through the coupling window into the next cavity.

The main cover 302 is coupled to an upper portion of the sub-cover 306, and may be fastened by bolts.

The sliding member 304 is installed so as to be able to slide in the directions orthogonal to the standing direction of the resonators; that is to say, in the horizontal directions. The sliding member 304 is installed in the guide groove formed into the top of the sub-cover, and may be made to slide automatically using a motor or manually by the user.

Although not shown in FIG. 3, the sliding member may be made to slide by a motor included inside the filter; a portion of the sliding member may protrude outside, being coupled with a motor that provides driving force. As driving mechanisms for the sliding member are widely known, a detailed explanation regarding it is omitted.

The number of sliding members 304 may correspond to the number of lines of resonators in the filter. FIG. 3 illustrates a filter having two lines of resonators, each line with four resonators, and corresponding to this, the number of sliding members 304 is shown to be two.

Coupled to a lower portion of each sliding member are tuning elements 330. The tuning elements 330 are put through the elongated holes 322 in the sub-cover 306 into the filter's interior, and these tuning elements 330 are made of a metallic material. On the other hand, the sliding member 304 should ideally be made of a dielectric material.

The tuning elements 330 are coupled to the underside of the sliding member 304, corresponding with the resonators 310 included in the filter. As there are four resonators under each of the sliding member 304, four tuning elements are coupled to the sliding member 304. Also, the interval between the tuning elements coupled corresponds to the interval between the resonators installed.

Corresponding with the sliding of the sliding member 304, the position of the coupled tuning elements 330 may also be varied. The tuning elements 330 form capacitance by their interaction with the resonators 310, and capacitance changes with the change in the position of the tuning elements 330.

Since capacitance is determined by the distance and the sectional area between two metals, the sectional area between the resonators and the tuning elements changes with the change in position of the metallic tuning elements, and accordingly, variance in capacitance occurs, making tuning possible as regards the characteristics of the filter.

If there are a multiple number of sliding members, the sliding members can be made to slide independently or can be made to slide collectively by means of a single motor. In cases where the sliding is performed collectively, it is possible to collectively apply tuning for all resonators of the filter.

Although it is not shown in FIG. 3, the tuning bolts for tuning may be inserted from the sub-cover 306 into the filter at the time of manufacture. The role of the inserted tuning bolts is the same as with the filter according to the related art.

With reference to FIG. 3, the shape of the resonator is fan-shaped, unlike that of the related art. The reason for making the cross section of the resonator fan-shaped in an embodiment of the present invention is for maximizing the tuning range of the tunable filter. The detailed structure of the resonator according to certain embodiments of the present invention will be explained with reference to separate drawings.

Figure 4:
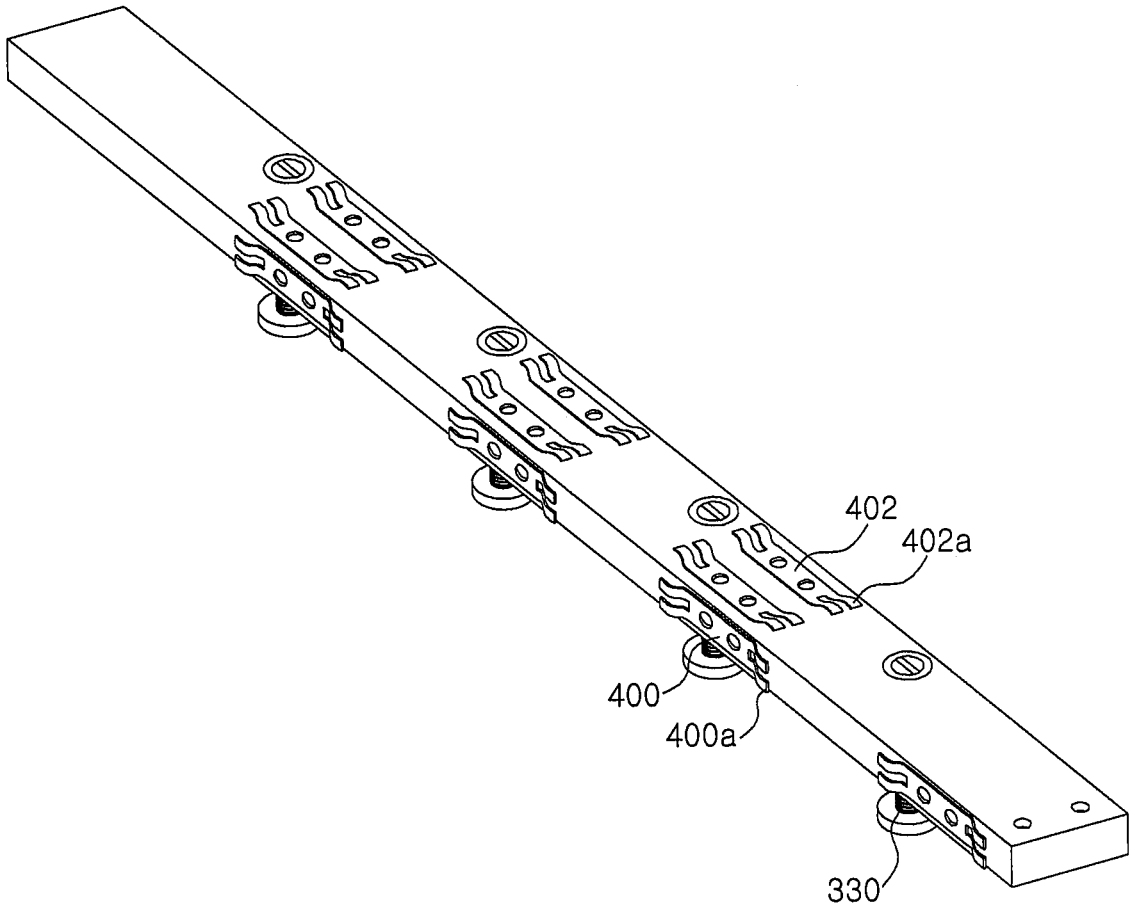
FIG. 4 is a perspective view of a sliding member according to an embodiment of the present invention.
Figure 5:
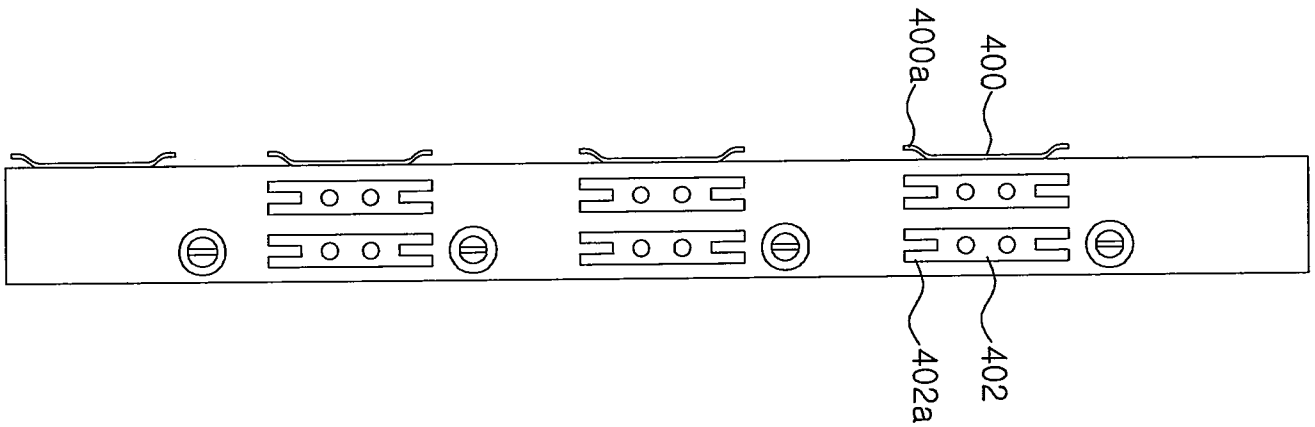
FIG. 5 is a plan view of a sliding member according to an embodiment of the present invention.
Figure 6:
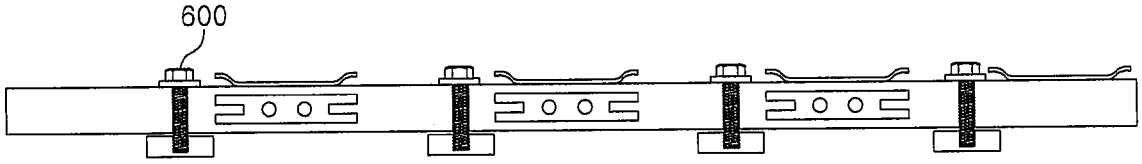
FIG. 6 is a cross-sectional view of a sliding member according to an embodiment of the present invention.

FIG. 4 is a perspective view of a sliding member according to an embodiment of the present invention, FIG. 5 is a plan view of a sliding member according to an embodiment of the present invention, and FIG. 6 is a cross-sectional view of a sliding member according to an embodiment of the present invention.

With reference to FIGS. 4 to 6, the tuning elements 330 are coupled to the sliding member in a particular interval, and as described above, the interval between the tuning elements 330 corresponds to the interval between the resonators.

With reference to FIG. 6, the metallic tuning elements 330 are coupled to the sliding member by bolts 600. FIG. 6 shows disc-shaped metallic tuning elements 330, but the shape of the tuning elements is not thus limited, and it would be apparent to those skilled in the art that it may be implemented in a variety of shapes.

With reference to FIGS. 4 to 6, several first guide members 400 may be coupled to one side of the sliding member 304, while several second guide members 402 may be coupled to an upper portion of the sliding member. While FIGS. 4 to 6 illustrate an example in which there are first guide members 400 coupled to one side only, the first guide members 400 can just as well be coupled to both sides of the sliding members 404.

The first guide members 400 and the second guide members 402 serve to guide the sliding member 304 to slide in a stable manner. The sliding member 304 should only slide along the length, and when sliding, any movement up-and-down or side-to-side should be eliminated.

The first guide member 400 and the second guide member 402 eliminate any unnecessary movement up-and-down or side-to-side and make the sliding member slide only in the predetermined directions.

According to a preferred embodiment of the invention, the first guide members 400 and second guide members 402 can be made from an elastic material, and can be implemented in the form of flat springs, for example.

With reference to FIGS. 4 to 6, the first guide member 400 and the second guide member 402 have the structure of flat springs having plural elastic wings 400*a*, 402*a*. The elasticity of the elastic bodies have the advantage of preventing the sliding member from moving in directions other than the sliding directions, and of minimizing friction when sliding.

The wings 400*a*, 402*a* are in contact with a side surface of the guide groove formed in the sub-cover and with the main cover, and allow stable guide motion due to their elasticity.

Besides this, the elastic bodies may be utilized as guide members in a variety of forms, and it would be apparent to those skilled in the art that such modifications are included within the scope of the present invention.

Heretofore, various embodiments of a tunable filter to which the present invention may be applied have been examined with reference to FIGS. 3 to 6, but the tunable filter to which the present invention may be applied is not limited to that illustrated in FIGS. 3 to 6, and it would be apparent to those skilled in the art that it may be applied to a variety of structures of the tunable filter using a sliding system.

Figure 7:
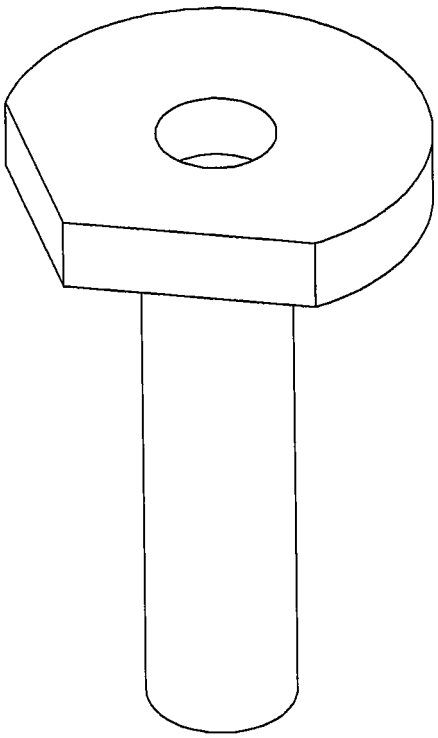
FIG. 7 is a perspective view of a resonator according to a first embodiment of the present invention.
Figure 8:
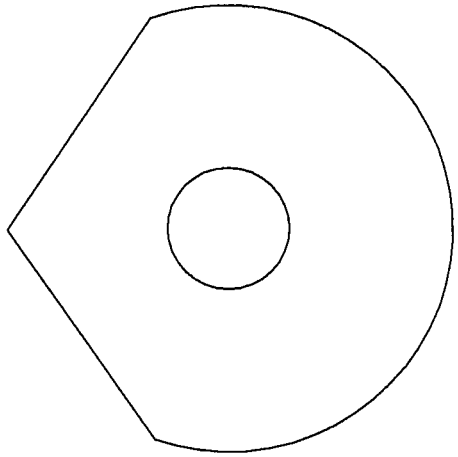
FIG. 8 is a cross-sectional view of a resonator according to the first embodiment of the present invention.
Figure 9:
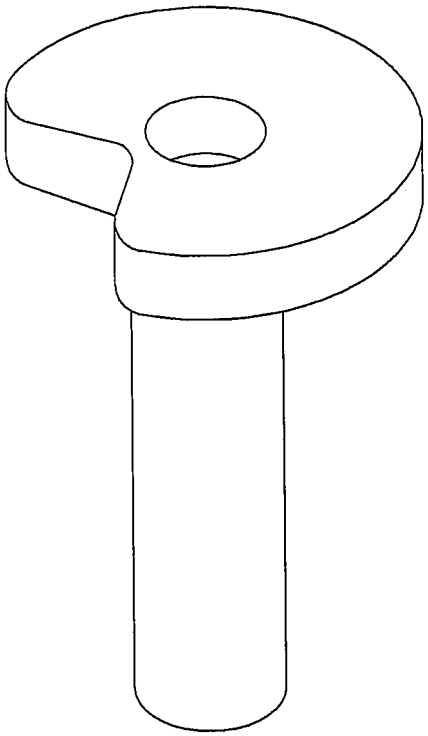
FIG. 9 is a perspective view of a resonator according to a second embodiment of the present invention.
Figure 10:
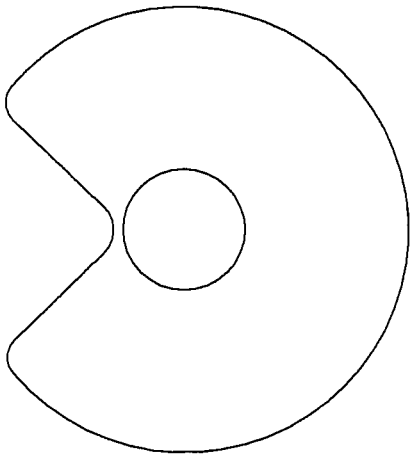
FIG. 10 is a cross-sectional view of a resonator according to the second embodiment of the present invention.

FIG. 7 is a perspective view of a resonator according to a first embodiment of the present invention, and FIG. 8 is a cross-sectional view of a resonator according to the first embodiment of the present invention. Also, FIG. 9 is a perspective view of a resonator according to a second embodiment of the present invention, and FIG. 10 is a cross-sectional view of a resonator according to the second embodiment of the present invention.

The structure of a resonator according to the related art has a disc-shaped conductor coupled to an upper portion of a cylindrical conductor. According to an embodiment of the present invention, a structure is proposed in which the tuning range is expanded through changes in the shape of the disc-shaped conductor in an upper portion of the resonator.

With reference to FIGS. 7 and 8, the disc-shaped conductor according to the first embodiment of the present invention has a portion removed so that its cross section is fan-shaped. In the first embodiment, the angle of the fan is less than 90 degrees, making it an acute angle. The reason for removing a portion of the disc-shaped conductor that is positioned over a resonator, thus making its cross section fan-shaped, is for expanding the tunable filter's tuning range.

In an embodiment of the present invention, the capacitance for tuning is determined by the area of overlap between the resonator's fan-shaped conductor and the tuning element 330, one placed over the other. As the tuning element 330 slides along, the area of overlap between the resonator's fan-shaped conductor and the tuning element 330 changes, and the filter is tuned accordingly.

However, if a disc-shaped resonator of the related art is used, when the entire tuning element is positioned over the disc-shaped conductor, the overlapped cross section between the resonator's disc and the tuning element does not change even with the tuning element sliding, and thus has the problem of the tuning range being limited.

Figure 11:
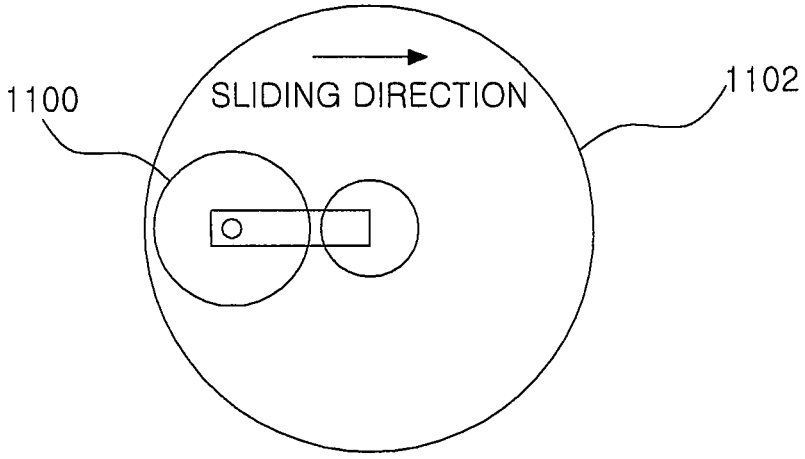
FIG. 11 is a drawing illustrating an example in which the entire tuning element is placed on a disc-shaped conductor when a disc-shaped resonator is used according to the related art.

FIG. 11 is a drawing illustrating an example in which the entire tuning element is placed on a disc-shaped conductor when a disc-shaped resonator is used according to the related art.

As shown in FIG. 11, if the tuning element 1100 is entirely overlapping the disc-shaped conductor 1102, even when the tuning element slides to the right, no change in capacitance occurs.

Even when a disc-shaped resonator according to the related art was used, the problem as in FIG. 11 was the main cause for the tuning range being limited.

In order to resolve such problems, an embodiment of the present invention allows the overlap area between the tuning element and the disc-shaped conductor to vary when the tuning element slides along, by having the conductor coupled to an upper portion of the resonator have a fan-shaped cross section.

Figure 12:
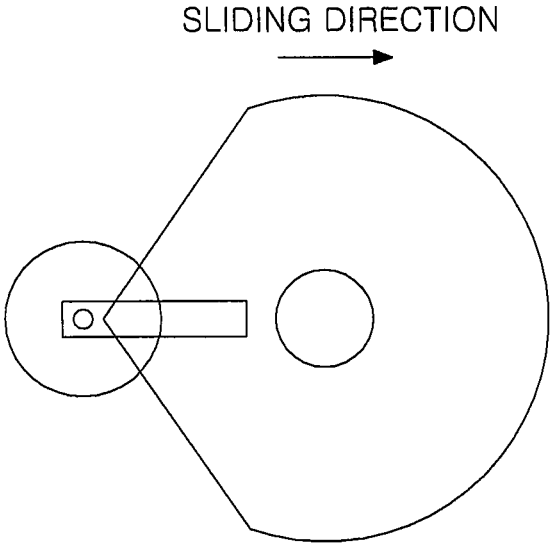
FIG. 12 is a drawing illustrating the relationship between a fan-shaped conductor and a tuning element when a resonator according to the first embodiment of the present invention is used.

FIG. 12 is a drawing illustrating the relationship between a fan-shaped conductor and a tuning element when a resonator according to the first embodiment of the present invention is used.

With reference to FIG. 12, if a conductor having a fan-shaped cross section is used as in the first embodiment, the overlap area gradually increases when the tuning element slides to the right. Consequently, the tuning range may be expanded, compared with when a disc-shaped conductor is used.

With reference to FIGS. 9 and 10, the resonator according to the second embodiment is fan-shaped, but the angle of the fan is greater than 90 degrees, making it an obtuse angle. Even if the resonator is shaped as in FIGS. 9 and 10, the same effect may be achieved as with the first embodiment.

Figure 13:
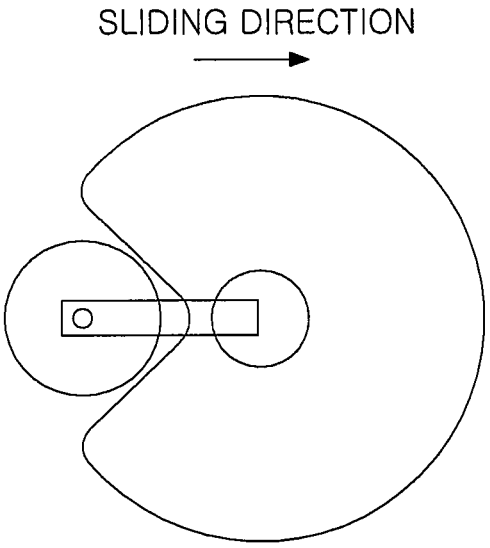
FIG. 13 is a drawing illustrating the relationship between a fan-shaped conductor and a tuning element when a resonator according to the second embodiment of the present invention is used.

FIG. 13 is a drawing illustrating the relationship between a fan-shaped conductor and a tuning element when a resonator according to the second embodiment of the present invention is used.

With reference to FIG. 13, when the tuning element slides to the right, the tuning range may be expanded as the overlap area between the resonator and the tuning element gradually increases.

In the aforementioned embodiments, explanations were given on the resonator's disc-shaped conductor having a fan-shaped cross section according to the first and second embodiments, but the present invention is not limited to only having a disc-shaped conductor of a fan-shaped cross section for its resonator, and it would be apparent to those skilled in the art that the present invention may include any structure that allows the overlap area between the disc-shaped conductor and the tuning element to increase gradually as the tuning element slides along.

Figure 14:
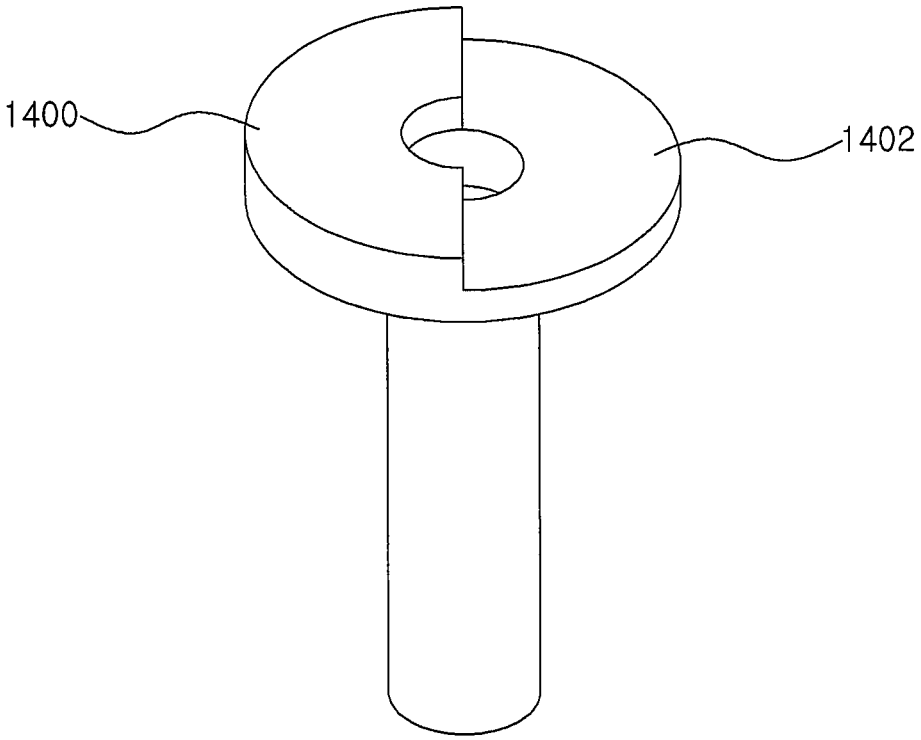
FIG. 14 is a perspective view of a resonator according to a third embodiment of the present invention.

FIG. 14 is a drawing illustrating a perspective view of a resonator according to a third embodiment of the present invention.

With reference to FIG. 14, the resonator according to the third embodiment of the present invention has a step formed on its top. With this step formed on the top of the resonator, the top of the resonator has a higher part 1400 and a lower part 1402.

In this manner, if a resonator having a stepped top is used, an even wider tuning range can be obtained as the distance between the resonator and the tuning element changes for each part.

The invention claimed is:

1. A tunable filter for expanding tuning range, the tunable filter comprising:

a housing having a plurality of cavities defined by partitions;

a plurality of resonators, wherein a respective one of the plurality of resonators is contained in a corresponding one of the plurality of cavities;

at least one sliding member installed over the plurality of resonators;

a main cover coupled to an upper portion of the housing; and at least one tuning element coupled to a lower portion of the at least one sliding member and made of a metallic material, wherein tuning is accomplished by a sliding motion of the at least one sliding member, and each of the plurality of resonators comprises:

a cylindrical first conductor; and a second conductor coupled to an upper portion of the cylindrical first conductor, and wherein a cross section of the second conductor is shaped as a fan such that an area of overlap between the at least one tuning element and the second conductor is varied according to a sliding of the at least one tuning element.

2. The tunable filter according to claim 1, further comprising:

a sub-cover positioned between the main cover and the plurality of resonators, the sub-cover having a guide groove formed therein for installing the at least one sliding member.

3. The tunable filter according to claim 2, wherein an elongated hole is formed in the guide groove of the sub-cover, so as to allow the at least one tuning element to be inserted in the housing and enable the at least one tuning element to freely undergo a sliding movement.

4. The tunable filter according to claim 2, wherein at least one first guide member is coupled to at least one side surface of the at least one sliding member, the at least one first guide member configured to guide a sliding movement of the at least one sliding member by way of contact with a side surface of the guide groove.

5. The tunable filter according to claim 4, wherein at least one second guide member is coupled to an upper portion of the at least one sliding member, the at least one second guide member configured to guide a sliding movement of the at least one sliding member by way of contact with a lower portion of the main cover.

6. A resonator to be equipped in a tunable filter for performing tuning by way of a sliding system, the resonator comprising:

a cylindrical first conductor; and a second conductor coupled to an upper portion of the first conductor, wherein a cross section of the second conductor is shaped as a fan.

* * * * *